United States Patent [19]

Amos

[11] Patent Number: 4,712,473

[45] Date of Patent: Dec. 15, 1987

[54] METHOD AND APPARATUS FOR MARKING AND FORMING WORKPIECES

[75] Inventor: Charles W. Amos, Bowling Green, Ohio

[73] Assignee: Owens-Illinois Closure Inc., Toledo, Ohio

[21] Appl. No.: 831,956

[22] Filed: Feb. 24, 1986

[51] Int. Cl.[4] ..... B44B 5/00

[52] U.S. Cl. ..... 101/4; 101/93.04; 101/32; 101/29

[58] Field of Search ..... 101/93.04, 93.05, 18, 101/29, 4, 32; 400/122

[56] References Cited

U.S. PATENT DOCUMENTS

| | | | |
|---|---|---|---|
| 1,026,790 | 5/1912 | Douglass | 101/4 |
| 2,533,528 | 12/1950 | Somersall | 101/4 X |
| 2,596,721 | 5/1952 | Pentecost et al. | 101/18 |
| 4,392,493 | 7/1983 | Niemeijer | 101/26 X |
| 4,473,008 | 9/1984 | Heyman | 101/150 X |

OTHER PUBLICATIONS

Crabtree, et al.; "Serial Number Stamp Machine"; *IBM Technical Disclosure Bulletin;* vol. 11, No. 12, p. 1752; May 1969.

*Primary Examiner*—Clifford D. Crowder
*Attorney, Agent, or Firm*—H. G. Bruss

[57] ABSTRACT

A forming station for can end closures which includes a pair of opposed die structures. Apparatus for forming code markings in the can ends as they are processed includes a plurality of arrays of incising pins retained in matrix configurations in the face of one of the opposed die pieces. The ends of predetermined pins in each array are supported above the die surface to form recognizable patterns in the can ends. The indicia being formed can be quickly changed by substituting a new pin support surface configuration.

16 Claims, 6 Drawing Figures

METHOD AND APPARATUS FOR MARKING AND FORMING WORKPIECES

BACKGROUND OF THE INVENTION

1. Field of the Invention

This invention relates generally to forming indicia on work pieces and, more particularly, to a method and apparatus for permanently code marking container components, whether the container body or a closure therefor.

2. Description of the Prior Art

It is desirable to provide code marking on products to identify, for example, the date of manufacture, lot number, plant, and the like so that when production problems are detected the source of the problem may be more easily detected and necessary corrections made. Moreover, if the product is utilized to contain food, beverage or other items which may be subject to deterioration with the passage of time, and if the container is manufactured on the same day as it is filled with such items, then marking may be used to indicate a date by which contained item must be used.

A number of methods have been used in the past for code marking products including various types of date and other indicia stamping with ink. However, ink is not a satisfactory solution when the product has subsequent handling, washing or other process steps that may remove all or part of the indicia. Further, contact between an ink indicia and items contained by the product may not be desirable from a health standpoint.

As an alternative, such indicia have been permanently impressed on a product being manufactured. This approach has been used in die and mold forming processes by cutting on the die elements or in the mold cavities the indicia to be inscribed on the product. However, if the code marks or indicia need to be changed frequently, as in a date of manufacturing coding, then it requires shutting down production equipment for extended periods with an attendant loss of production and increase in labor costs. Moreover, such mold and die elements may then have to be discarded or reworked to provide a new set of desired indicia.

SUMMARY OF THE INVENTION

Apparatus is disclosed for permanently code marking or placing indicia on a work piece, such as container components including both container bodies and closures therefor. Cooperating work piece forming members, such as opposed die elements or two walls of a mold, have work piece contact or component adjacent surfaces positioned to receive a work piece between them.

Although only one array may be utilized, there would usually be a plurality of arrays of incising elements or pins retained in a matrix. The incising ends of predetermined pins may be raised into an active incising position with respect to other pins in the matrix which are in a lower inactive or idle position. This permits a recognizable pattern to be formed by both the raised or active pins and in the work piece after in incising step.

Apertures or cavities are formed in the work piece contact surface of one of the forming members to receive each of the arrays of incising pins. A passage or support slot is also molded, machined or otherwise formed in the same forming member to afford access between an area or region of the forming member that is readily accessible and the bottom of the array receiving cavity.

A support member is positioned in the passage or slot to selectively engage control ends of predetermined pins in an array to maintain the selected pins in an extended active or incising position with respect to the forming or component adjacent surface of the member. The non-selected pins have their incising ends located at or behind the forming surface to prevent any impressions being made in the work piece.

In the illustrative embodiment shown herein the selective support or engaging means includes a support or stop member cooperating with a shim or spacer member.

The support or stop member may have a first surface for receiving the support or control ends of predetermined elements, which holds those pins in an active or incising position and stops them from being moved out of such position by pressures exerted during work piece forming.

The support member may also have a second surface which is displaced from the first surface, and from the working piece forming surface which supports the control ends of the incising pins that are not selected in an idle or inactive position at or behind the work piece forming surface.

In cooperation with the support member a shim or spacer member is positioned in the passage or slot to urge the support member into the desired pin engaging position. In addition, the removal of the spacer member enables the easy removal of the support member. That is, in the embodiment shown, the support member may then be lowered into the space formerly occupied by the spacer member so that all surfaces clear the support ends of the pins, enabling the support member to simply slide out of the slot or passage.

Therefore, another support member moving differently configured support or pin engaging surfaces may then be inserted to change the code or indicia pattern formed by the newly selected incising pins. After reassembly, the support and spacer members are removably secured to the die structure or other work piece forming member.

The object of this invention, therefore, is to provide an improved method and apparatus for forming identifying indicia in a work piece by placing cooperative work piece forming members on opposite sides of a work piece and positioning a plurality of incising elements in an array extending through and to the forming surface of one of the members. By selectively supporting predetermined elements in an incising position a recognizable pattern may be formed in the work piece. The indicia being incised may be quickly changed by exchanging support members having differently configured support surfaces for the incising elements.

Other objects, advantages and features of the invention will become apparent during the course of the following description when read in conjunction with the accompanying drawings.

BRIEF DESCRIPTION OF THE DRAWINGS

In the drawings, where like numerals are employed to designate like parts throughout.

DESCRIPTION OF THE PREFERRED EMBODIMENT

The teachings of the invention are illustrated in connection with the forming and assembly techniques used in the making of a thin walled container, in which one wall has a tear strip with a tab attached thereto. Such sealable containers usually hold food or other products which may be subject to deterioration on exposure to the atmosphere. They may be opened when desired without having to use a can opener or other tool.

The openable wall in this instance is a can end made from a deformable material such as an aluminum alloy, steel, plastic or the like. On a mass production basis, the can end is advanced step by step through a plurality of stations having forming dies which stamp or emboss the desired can top configurations.

Figure 1:
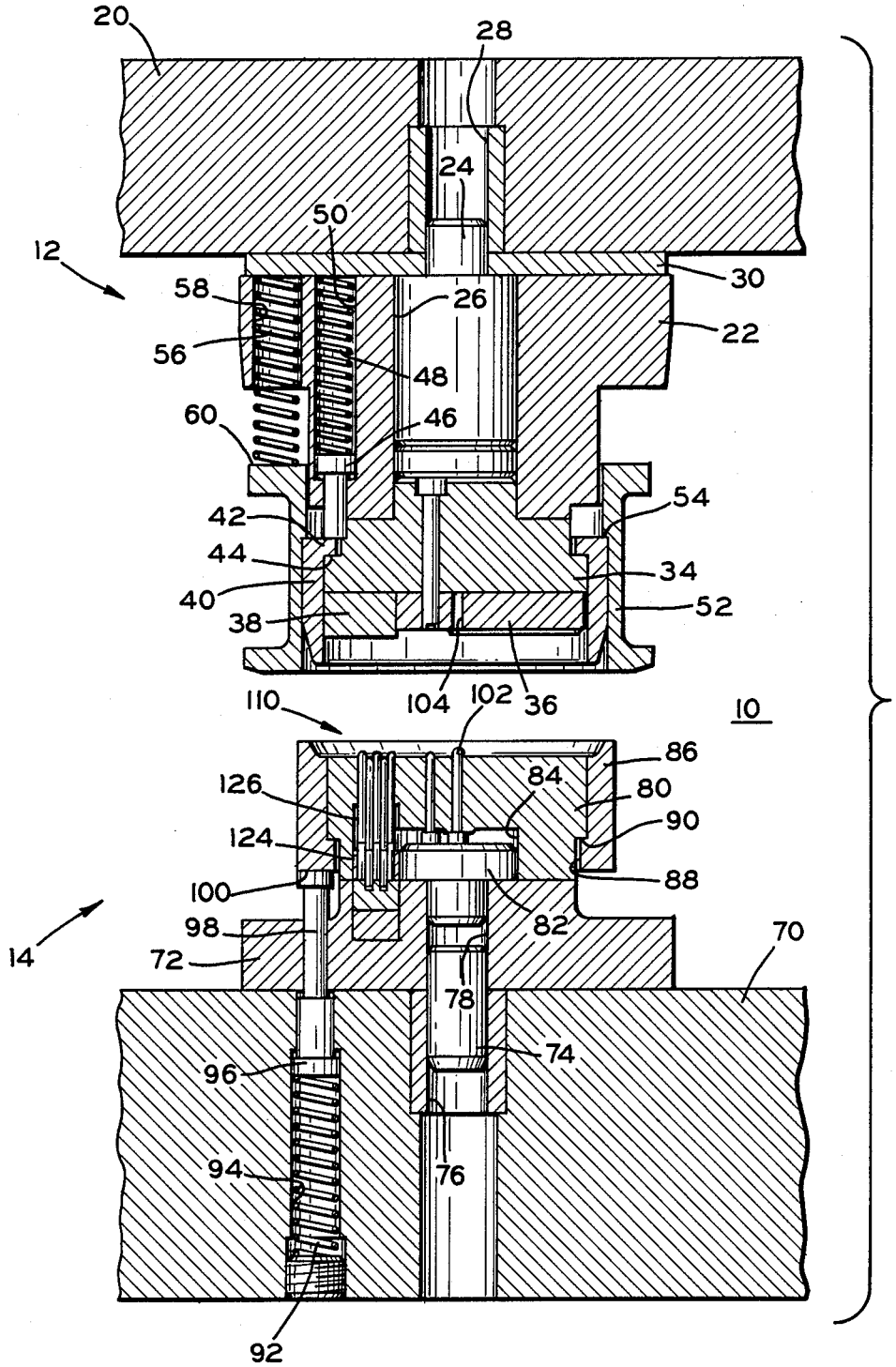
FIG. 1 is a side elevational view, partially in section, of a work piece forming station embodying the teachings of this invention.

Such a forming or assembly station 10 is illustrated in FIG. 1. The station 10 includes an upper die structure 12 and a lower die structure 14 which are cooperatively operated in an inverted press fashion, with the lower die structure 14 being lifted into contact with the upper die structure 12.

The upper die structure 12 includes an upper die shoe 20 mounted on the underside of a base plate or other support means (not shown) in a conventional manner. An upper die block or centering tool 22 is positioned in a desired location by a center locating pin 24, which has its lower end received by a bore 26 formed in die block 22 and its upper end received in a bore 28 formed in upper die shoe 20. A hard shim or spacer 30 is utilized between shoe 20 and die block 22 for adjusting the working height of upper structure 12.

A score tool holder 34 connected to die block 22 supports a score insert or tool 36 and an incising anvil 38. A cylindrically shaped upper centering or locating ring 40 is journally supported on score tool holder 34, and has an inwardly extending upper flange 42 that rests on a shoulder 44 formed on score tool holder 34. The flange 42 is yieldingly urged into contact with the shoulder 44 by pin means 46 journally supported in die block 22. Spring means 48 located in a spring chamber 50 formed in die block 22 supplies the yielding force to urge pin means 46 downwardly.

A cylindrically shaped stripping pad 52 is journally supported on the outside of the locating ring 40 to remove a can end or work holder from the upper die structure 12 at the end of a station cycle. An internal shoulder 54 of the pad 52 rests on the upper end of locating ring 40, and is held in yielding engagement therewith by spring means 56. A spring chamber 58 formed in upper die block 22 holds the spring means in position against an upper surface 60 of stripping pad 52.

The lower die structure 14 includes a lower die shoe 70 mounted on a base plate or other support means (not shown) in a conventional manner. A lower die block or base 72 is positioned in a desired location by dowel pin 74, having its lower end received by a bore 76 formed in lower die shoe 70 and its upper end received by a bore 78 formed in die block 72.

A score anvil 80 is mounted on die block 72 and positioned by a center locating pin 82 having a lower end located in the central bore 78 of die block 72 and an upper end located in bore 84 formed in the score anvil 80.

A cylindrically shaped lower locating ring 86 is journally supported on the external surface of the score anvil 80. The ring 86 has an inwardly extending lower flange 88 that is yieldingly urged into an abutting relationship with a shoulder 90 formed on the score anvil 80 by spring means 92. A spring chamber 94 formed in lower die shoe 70 retains spring means 92 so that force is transmitted upwardly by spring lifter pins 96, 98 against a lower surface 100 of locating ring 86.

The score anvil 80 may also carry forming tools such as a male die 102 which pushes up a dimple in the can end in cooperation with female die 104 in score inserts 36, which will eventually be formed into a rivet for attaching a pull tab to the can end.

Figure 2:
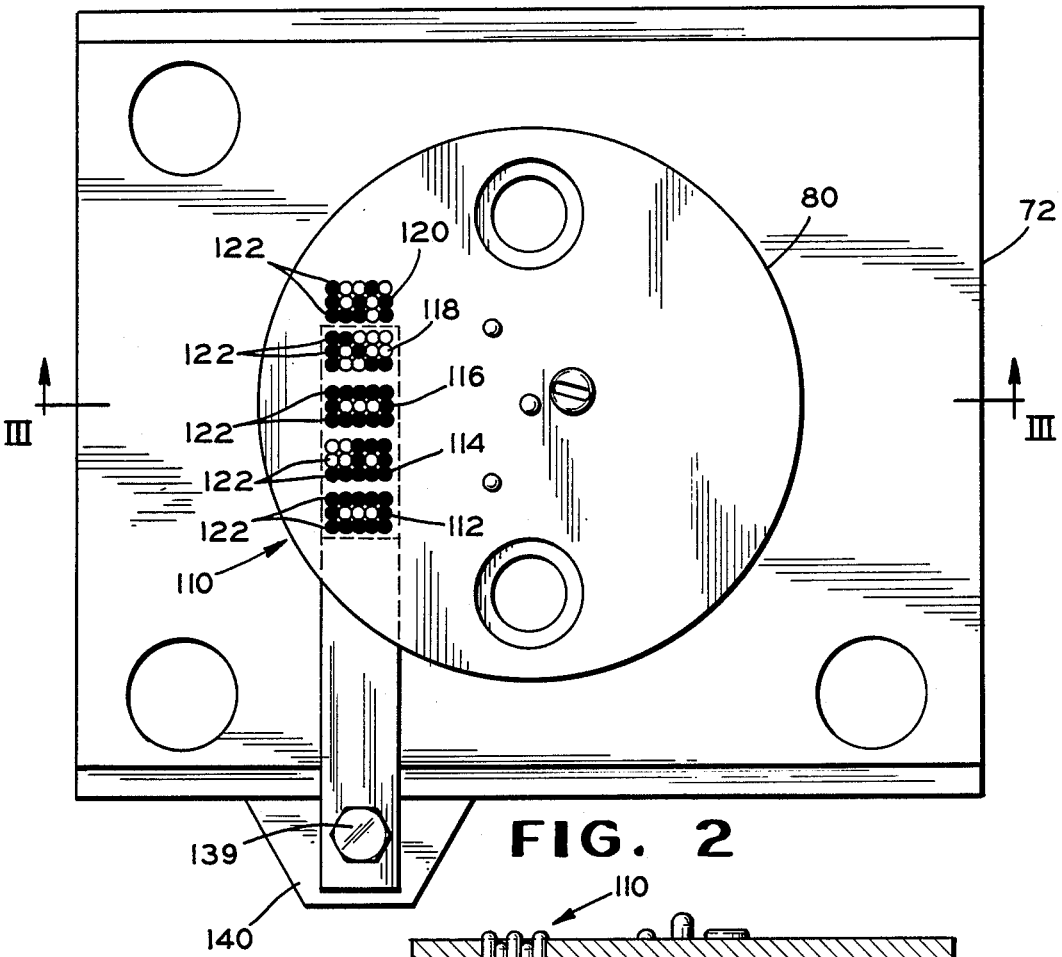
FIG. 2 is an enlarged plan view of the lower die structure illustrated in FIG. 1.
Figure 3:
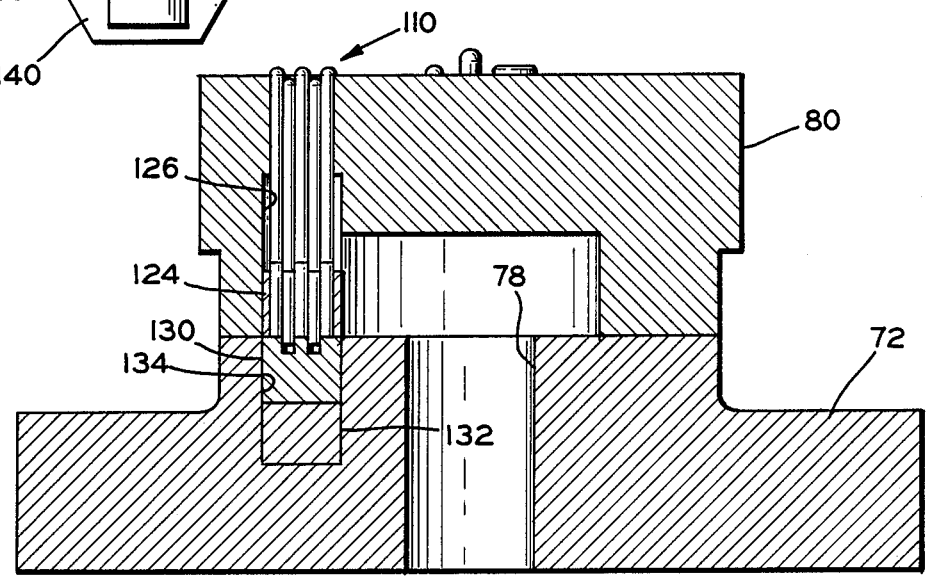
FIG. 3 is a sectional view taken substantially along lines III—III of FIG. 2.

A coding means is indicated generally at 110 in FIGS. 1, 2 and 3 and includes a plurality of clusters 112, 114, 116, 118 and 120 of incising pins 122. In the embodiment shown, each cluster has fifteen of the pins 122 grouped in a rectangular array of three pins wide by five pins long. The cluster of pins 122 are maintained in the arrays by a pin retainer member 124 which is inserted into a slot 126 formed in the lower side of score anvil 80.

Each pin 122 within a cluster is vertically movable with respect to the other pins in the cluster. The distance of movement downwardly of each pin is controlled by an activator in a slot 134 formed in the lower die block 72 and aligned with slot 126 formed in the score anvil 80 (See FIG. 3).

Figure 4:
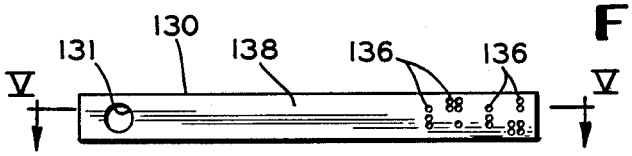
FIGS. 4 and 5 are plan and side views, respectively, of a selectivesupport means utilized in the apparatus of FIGS. 1 and 3.
Figure 5:
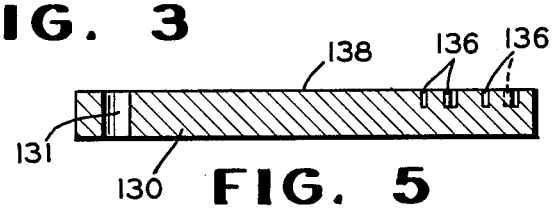

As best seen in FIGS. 4 and 5 the activator bar 130 will have a predetermined number of holes 136 bored in the top surface 138 thereof. The holes are selectively bored in an aligned position with certain pins 122, so that those pins may slide down into the holes 136 lowering the upper incising ends of pins 122 below the upper surface of score anvil 80. The remainder of the pins 122 in each cluster will be maintained in an incising position with their upper ends protruding above the upper surface of score anvil 80, because the lower ends of those pins will be supported by the upper surface 138 of bar 130.

In operation, conventional workholder will move the work pieces on which operations are to be performed into and out of the station 10 in a known manner. After a work piece, in this instance a can end, is moved into forming position between the upper die structure 12 and the lower die structure 14, the lower die structure 14 is moved upwardly. The locating ring 86 may first engage a workholder from below to position the can end held therein with respect to upper and lower tool and anvil surfaces. As the lower structure 14 continues upwardly the workholder meets and pushes the stripping pad 52 upwardly against the spring force of spring means 56.

The upward movement of pad 52 exposes the lower surface of the upper centering or locating ring 40, which cooperates with the upper surface of the workholder to continue to center the work piece with respect to upper and lower die and anvil surfaces. As the upward movement of structure 14 continues the lower locating ring 86, upper locating ring 40, and stripper pad 52 are moved away from the upper and lower die and anvil surfaces against the yielding force of spring means 92, 48 and 56, respectively, permitting the scoring, dimple formation and coding incising operations to take place.

After the forming and incising operations are completed, the lower structure 14 is moved downwardly. Because the lower surface of stripper pad 52 depends below the lower surface of upper locating ring 40. The spring means 56 will push and strip the workholder/-work piece assembly off of and away from the upper locating ring 40.

As the lower structure 14 continues to move downwardly the lower locating ring 86 with disengage from the workholder/work piece assembly, and the cycle is complete. The workholder may then move the work piece to the next operation station.

Referring again to the coding means 110, as best seen in FIG. 2, each cluster of incising pins forms a matrix of dots. By raising predetermined pins to an incising level above the upper surface of the score anvil 80 a recognizable pattern may be formed. This pattern is transferred to the deformable material being processed at the station 10 when the score anvil 80 brings the can end into contact with the incising anvil 38 held by score tool holder 34.

To illustrate the pattern formation, the tops of the pins 122 which have been raised to an incising position in FIG. 2 have been shaded. Those pins left at or below the upper surface of the score anvil have been left unshaded. The resultant patterns can be recognized as a "0", "6", "0", "7" and a "5". If the coding means were being used to date the day of manufacture of the can end the first two numbers could designate the month and the next two numbers could designate the day of the month. Only one number is shown as designating the year, because in many instances the product is used within the same or next successive year, therefore not requiring the decade indication. The date illustrated in this example is June 7, 1985.

The major advantage of the invention lies in the ability to modify the coding of a date, for example, without requiring production equipment to be shut down for extended periods causing a loss of production and an increase in labor costs.

Figure 6:
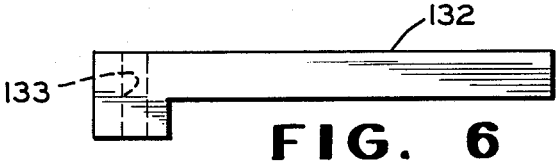
FIG. 6 is a side view of a spacer element used in the apparatus described herein.

This can be accomplished quickly in the embodiment shown by simply removing bolt 139 from the bores 131, 133 formed in activator and riser bars 130, 132 (best seen in FIGS. 4, 5 and 6) where it is removably secured to a flange 140 extending from the lower die block 70. The riser bar 132 is removed from its activator bar supporting position in slot 134. This permits the activator bar 130 to be lowered in slot 134, disengaging the lower ends of incising pins 122 from the pin receiving holes 136 formed in the upper surface 138 of the activator bar 130. The activator bar 130 can then be withdrawn from slot 134.

If the coding method is being used to identify each day in the year, a set of 365 bars can be prepared with predetermined patterns of holds 136, so that a bar 130 is available for each date. A bar 130 with the desired new date pattern is then slid into the bottom of the slot 134, and then lifted to receive the idle incising pins in holds 136 while the active or pattern-forming pins 122 are supported on the upper surface 130. The riser bar 132 is then inserted into slot 134 to support the bar 130 in its pin activating position. Bolt 138 is slipped through holes 131, 133 in bars 130, 132 and is removably secured to flange 140.

It should be noted in the present embodiment that the "year" date pattern forming cluster assembly 120 may be constructed so that it is separate from the remainder of the "month" and "day" coding patterns. For example, a downwardly extending vertical rectangular slot may be formed in the upper face of the score anvil so to retain the fifteen incising pins 122 of the year date cluster 120. Alternatively, fifteen individual holds may be drilled vertically into the upper surface of anvil 80 to hold the cluster of pins 122.

In either construction, pattern forming pins 122 of sufficient length to extend above the upper surface of the score anvil 80 would be located in the vertical slot in the desired pattern, and would be held in that pattern by filling in the remainder of the array or matrix with shorter pins which would not extend above the upper surface of anvil 80.

In this instance, the activator bars 130 would need only contain "month" and "day" patterns of holes 136 formed therein. The pins in cluster 120 would be changed only once each year to provide the pattern needed for the next year.

It is to be understood that while the embodiment discloses a method for coding numbers as indicative of dates, the numbers may be used to represent other codes besides dates. In addition, matrix patterns may also form numbers or other symbols or indicia to provide the coding desired. Moreover, while the invention is particularly useful in the can end forming process shown, it is also applicable to any method or apparatus in which a deformable material is processed, formed, molded, etc. Therefore, the form of the invention herein shown and described is to be taken as illustrative only, and changes in the shape, size and arrangement of the parts or in the steps of the method may be made without departing from the spirit and scope of the invention.

I claim:

1. Apparatus for forming and placing indicia on a work piece, comprising;

(a) cooperating work piece forming members for forming a work piece by contact therewith, each member having work piece contact surfaces positioned to receive a work piece therebetween, one of said work piece contacting surfaces having an aperture formed therein for receiving incising means, (b) incising means including a plurality of elements retained in an array in said aperture in said contact surface, each of said elements having an incising end and a support end, and (c) means removably secured to said forming member receiving said incising means for selectively supporting each of said incising elements in one of two positions, a first position locating an incising end above said contact surface and a second position locating an incising end at or below said contact surface, thereby enabling a selected indicia to be incising on a work piece at the same time as the work piece is being formed by said contact surfaces.

2. Apparatus according to claim 1 wherein said cooperating work piece forming members comprises pressure-imposing die members disposed on opposite sides of a work piece.

3. Apparatus as defined in claim 1 in which said plurality of incising elements are retained in an array in which a recognizable pattern may be formed by the incising ends of said elements which are located above said work piece contacting surface.

4. Apparatus as defined in claim 1 in which said selective supporting means includes a support member having a first support surface for receiving support ends of incising elements in said first position and a second support surface displaced from said first surface for receiving support ends of incising elements in said second position.

5. Apparatus as defined in claim 4 in which said forming member receiving said incising means has a support slot formed therein for receiving said selective supporting means, said support slot and said incising means receiving aperture intersecting to provide communication therebetween.

6. Apparatus for placing indicia on a work piece, comprising:

(a) cooperating work piece forming members, each having work piece contact surfaces positioned to receive a work piece therebetween, one of said work piece contacting surfaces having an aperture formed therein for receiving incising means, (b) incising means including a plurality of elements retained in an array in said aperture in said contact surface, each of said elements having an incising end and a support end, and (c) means removably secured to said forming member receiving said incising means for selectively supporting each of said incising elements in one of two positions, a first position locating an incising end above said contact surface and a second position locating an incising end at or below said contact surface, (d) said forming member receiving said incising means having a support slot formed therein for receiving said selective supporting means, said support slot and said incising means receiving aperture intersecting to provide communication therebetween, (e) said selective supporting means further including a shim component located in said support slot and positioned to maintain said first and second support surfaces of said support member in the desired incising element support position.

7. Apparatus as defined in claim 6 in which said shim component is removable from said support slot to enable disengagement of said support member from supporting relationship with said incising elements and removal thereof.

8. Apparatus for permanently code marking container components during the process of forming the container components, comprising:

(a) first and second means for forming a container component positioned therebetween, said first means having an incising means receiving cavity formed in a component-adjacent surface thereof, said first means also having a passage formed therein providing access to said cavity from a region away from said component-adjacent surface, (b) a plurality of incising pins retained in an array in said cavity in said first forming means, (c) means positionable in said passage for engaging selected incising pins in said array and maintaining said selected pins in an active incising position at the component-adjacent surface of said first forming means, and (d) means for removably securing said engaging means to said first forming means.

9. Apparatus as defined in claim 8 in which (a) each of said incising pins has an incising end and a control end, and in which (b) said engaging means includes a stop member which has a stop surface formed to abut against the control ends of said selected incising pins to maintain the incising ends of said selected pins extended past said component-adjacent surface in an incising position.

10. Apparatus as defined in claim 9 in which said stop member further includes a second surface formed thereon aligned with non-selected pins and spaced from said stop surface a sufficient distance to enable the incising ends of non-selected pins to be moved behind said component-adjacent surface into an inoperative position.

11. Apparatus as defined in claim 8 which further includes a plurality of arrays of incising pins, and a like plurality of engaging means, thereby enabling formation of a plurality of code marks in said container component.

12. Apparatus as defined in claim 11 in which each said array contains a minimum of fifteen pins arranged in a three by five matrix enabling patterns of numerals and letters to be formed by each array.

13. Apparatus as defined in claim 8 in which said container components are can ends and in which said first and second forming means are opposed and cooperating pressure-imposing die members.

14. Apparatus for permanently code marking container components during the manufacturing process, comprising:

(a) first and second means for forming a container component, said first means having an incising means receiving cavity formed in a component-adjacent surface thereof, said first means also having a passage formed therein providing access to said cavity from a region away from said component-adjacent surface, (b) a plurality of incising pins retained in an array in said cavity in said first forming means, each pin having an incising end and a control end and, (c) a stop member positionable in said passage which has a stop surface for engaging selected incising pins in said array and maintaining said selected pins in an active incising position at the component-adjacent surface of said first forming means, (d) means for removably securing said stop member to said first forming means, and (e) spacer means positionable in said passage to maintain said stop member in contact with said selected pins, said spacer means being removable from said passage to permit said stop surface of said stop member to be withdrawn from contact with said selected pins a sufficient distance to enable said stop surface to avoid contact with control ends of non-selected pins thereby allowing removal of said stop member from said passage.

15. A method of forming identifying indicia in a work piece while also forming the work piece by contact therewith, comprising the steps of:

(a) placing cooperating work piece forming members on opposite sides of a work piece, (b) forming an aperture in one of said work piece forming members and positioning a plurality of incising elements in an array in said aperture extending through and to the work piece adjacent surface of said one of said work piece forming members, (c) selectively supporting each of said incising elements in one of two positions, a first position locating an element in an active incising mode extending beyond the surface of said work piece forming member and a second position locating an element in an inactive mode at or behind the surface of said work piece forming member, whereby the active elements define a recognizable pattern and (d) pressing the work piece forming members into contact with a work piece to form the work piece and impress indicia thereon.

16. A method of forming identifying indicia in a work piece, comprising the steps of;

(a) placing cooperating work piece forming members on opposite sides of a work piece, (b) positioning a plurality of incising elements in an array extending through and to the work piece adjacent surface of one of said work piece forming members, (c) selectively supporting each of said incising elements in one of two positions by placing a support member, having a first surface for supporting selected incising elements in a first position locating an element in an active incising mode to define a recognizable pattern and a second surface for supporting non-selected incising elements in a second position locating an element in an inactive mode at or behind the surface of said work piece forming member, against ends of said incising elements that are remote from said work piece adjacent surface, (d) forming a passage in said one of said work piece forming members to receive said support member, and (e) urging said support member into incising pin contact by inserting a removable spacing member into said passage, the removal of said spacing member permitting withdrawal of said support member a sufficient distance from said incising elements so that said support member can avoid impact with any of said elements and can be removed from said passage.

* * * * *